US006074498A

United States Patent [19]

Waldron et al.

[11] Patent Number: 6,074,498

[45] Date of Patent: Jun. 13, 2000

[54] HEAT TREATED AL-CU-LI-SC ALLOYS

[75] Inventors: Douglas J. Waldron, Palmdale; William F. Bozich, Huntington Beach, both of Calif.

[73] Assignee: McDonnell Douglas Corporation, Seal Beach, Calif.

[21] Appl. No.: 08/930,072

[22] PCT Filed: Oct. 28, 1996

[86] PCT No.: PCT/US97/18872

§ 371 Date: Oct. 28, 1997

§ 102(e) Date: Oct. 28, 1997

[87] PCT Pub. No.: WO98/18976

PCT Pub. Date: May 7, 1998

Related U.S. Application Data

[60] Provisional application No. 60/029,275, Oct. 28, 1996.

[51] Int. Cl.[7] ..... C22C 21/12; C22F 1/04

[52] U.S. Cl. ..... 148/416; 148/438; 148/695; 148/698; 148/699; 420/529

[58] Field of Search ..... 148/416, 438, 148/695, 698, 699; 420/529

[56] References Cited

U.S. PATENT DOCUMENTS 4,816,087 3/1989 Cho ..... 148/416

4,999,061 3/1991 Curtis et al. ..... 148/438

*Primary Examiner*—John J. Zimmerman

*Assistant Examiner*—Robert R. Koehler

*Attorney, Agent, or Firm*—Brooks & Kushman P.C.

[57] ABSTRACT

A dual aging treatment of aluminum-copper-lithium-scandium alloys allows preparation of alloys exhibiting superior physical properties as compared to the same alloys subjected to only a single aging. In particular, the difference between yield strength and ultimate tensile strength is markedly increased. The alloys are characterized by an array of fine T1 phase precipitates within the aluminum grain, leaving a substantially T1 phase precipitate-free zone along the grain boundaries, and an array of coarse θ' and δ' phase precipitates throughout the grains with little or no θ' and δ' phase-free zones.

19 Claims, 1 Drawing Sheet

HEAT TREATED AL-CU-LI-SC ALLOYS

This application claims benefit of Provisional Application No. 60/029,275 filed Oct. 28, 1996.

TECHNICAL FIELD

This invention relates to the processing of aluminum alloys and, more particularly, to the heat treatment of Al-Cu-Li-Sc alloys.

BACKGROUND ART

Many alloys of aluminum and other elements may be heat treated to control and improve their mechanical and physical properties. In one such process, the basic alloy material of the desired composition is melted and cast into a desired shape. The cast alloy material is deformation processed by rolling, extrusion, drawing, machining, or other technique to a desired size and shape. The deformation processed alloy material is thereafter heat treated to achieve particular mechanical and physical properties.

The most common heat treatment for aluminum alloys is solution treating and aging. The aluminum alloy is heated to a temperature at which the alloying elements dissolve into solid solution in the matrix. The aluminum alloy is then rapidly cooled ("quenched") to retain the alloying elements as solute in solid solution. The material is thereafter heated to an intermediate temperature ("aged") at which second-phase particles of different types, generally termed "precipitates", form by diffusional reactions between the alloying elements and possibly the aluminum matrix material. There may also be an associated mechanical deformation of the material to alter the grain structure and precipitate character of the material.

The presence of these precipitates improves the strength properties of the material by various mechanisms, but they may also have adverse effects on other properties such as elongation, fracture toughness, corrosion, stress corrosion, weldability, etc. The nature of the properties achieved depend upon the composition of the aluminum alloy. At the present state of metallurgical understanding, it is not possible to predict with certainty the response of a particular aluminum alloy to solution heat treating and aging procedures. Care is taken to develop particular solution treating and aging procedures for each alloy family. Thus, because a particular heat treatment is successful for one alloy family does not at all suggest that it will be successful for another alloy family, because of the different aging responses of the different materials.

Alloys of aluminum (Al) and lithium (Li) are of interest for aerospace applications because lithium has a low atomic weight and can serve, alone or in combination with other alloying elements, as the basis for solution treating and aging procedures. In one recently developed alloy, copper (Cu), scandium (Sc), and other alloying elements are added to an Al-Li material. This Al-Cu-Li-Sc alloy shows promise for a number of applications, such as cryogenic tankage and other structural elements. The addition of scandium has been found to markedly alter the alloy chemistry and grain structure.

When the Al-Cu-Li-Sc alloy is heat treated by solution treatment followed by a conventional aging at 130° C. for 8–12 hours to achieve high yield and tensile strengths, the elongation to failure is relative low. The result is that the fracture toughness is lower than desired for applications such as cryogenic tankage. There is therefore a need for an improved approach to the heat treatment of alloys, which allows the alloy to be tailored to exhibit specific combinations of mechanical and physical properties. The present invention fulfills this need, and further provides additional advantages as well.

DISCLOSURE OF INVENTION

The invention provides a heat treated Al-Cu-Li-Sc alloy and a method for its heat treatment. The properties of the Al-Cu-Li-Sc alloy processed in accordance with the invention are generally an excellent combination of yield and tensile strengths, difference between yield and tensile strength, elongation to failure, and fracture properties. The properties are controllable within limits, allowing optimization of the performance of the material for particular applications. The processing of the Al-Cu-Li-Sc alloy is compatible with other fabrication and processing procedures.

In accordance with the invention, a method for preparing an aluminum-alloy article comprises the steps of providing a piece of aluminum alloy comprising, in weight percent, from about 2.6 to about 3.3 percent copper, from about 2.0 to about 2.4 percent lithium, from about 0.05 to about 0.14 percent scandium, incidental elements selected from the group consisting of zirconium, titanium, cerium, boron, iron, silicon, magnesium, and sodium, and impurities, balance aluminum. After casting and, optionally, initial processing such as rolling or extrusion to a semi-finished state, the aluminum alloy is solution treated by first heating the alloy at a temperature and for a time sufficient to form a solid solution, and thereafter cooling the alloy at a cooling rate sufficient to suppress substantial precipitation of second phases. The aluminum alloy is thereafter aged in a two-step or "duplex" aging treatment. Optionally, the aluminum alloy is lightly deformed after solution treating and before aging, a process generally termed "stretching".

This processing imparts to the aluminum alloy a microstructure that is particularly conducive to achieving an optimal combination of mechanical and physical properties. In general, the microstructure has a fine grain size with relatively coarse θ' ($Al_2Cu$) and δ' ($Al_3Li$) precipitates and relative fine T1 ($Al_2CuLi$) precipitates in an aluminum alloy matrix. Preferably, the θ' and δ' precipitates are dispersed throughout the microstructure with relatively narrow precipitate-free zones at the grain boundaries, and the T1 precipitates are found primarily in the centers of grains with relatively wide T1 precipitate-free zones at the grain boundaries.

The heat treated Al-Cu-Li-Sc materials exhibit a good combination of yield and ultimate tensile strengths, with a good separation between the two values that is associated with a high elongation to failure. The high elongation to failure in turn leads to good fracture toughness properties and fatigue resistance, important characteristics for reusable structures.

While an embodiment of this invention is illustrated and disclosed, this embodiment should not be construed to limit the claims. It is anticipated that various modifications and alternative designs may be made without departing from the scope of this invention.

BEST MODE FOR CARRYING OUT THE INVENTION

Figure 1:
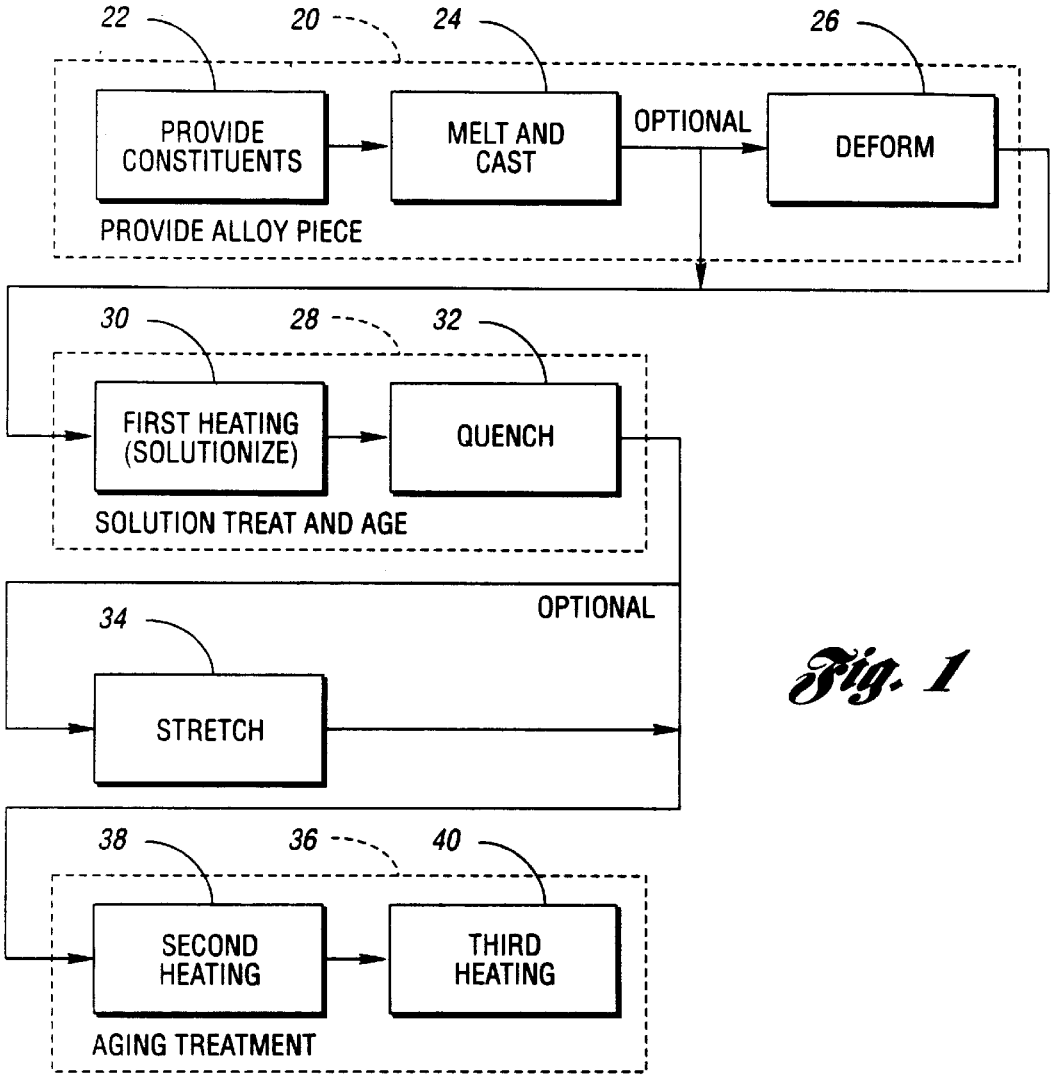
FIG. 1 is a block process flow diagram for a preferred method according to the invention.

FIG. 1 illustrates the preferred method for practicing the present invention. A piece of an aluminum alloy is provided, numeral 20. The piece has a composition, in weight percent, of from about 2.6 to about 3.3 percent copper, from about 2.0 to about 2.4 percent lithium, from about 0.05 to about 0.14 percent scandium, balance aluminum. Incidental elements such as zirconium, titanium, cerium, boron, iron, silicon, magnesium, and sodium may intentionally be present, and impurities due to the melting process may unintentionally be present, as long as they do not adversely affect the performance of the aluminum alloy and its heat treatment as will be described. This aluminum alloy is termed an "Al-Cu-Li-Sc" alloy after its primary intended constituents, although other elements may be presented as indicated above.

The constituents of the alloy are provided, numeral 22. These constituents are melted together and cast into ingots or in a continuous or semi-continuous (i.e., DC cast) fashion, numeral 24. Optionally, but preferably, the cast alloy material is deformed to a semi-finished form such as by hot rolling to plates or sheets, extrusion to shapes, or other technique, numeral 26. Casting and deforming are accomplished using conventional techniques known in the art.

The aluminum alloy piece is thereafter solution treated and quenched, numeral 28. After casting and optionally deforming during step 20, the aluminum alloy piece typically has an irregular microstructure with particles of second phases in an aluminum alloy matrix. The solution treating 28 produces a solid solution of alloying element solutes dissolved in the aluminum matrix. The solution treating 28 includes a first heating, numeral 30, to a temperature sufficiently high and for a time sufficiently long that the particles dissolve into the matrix and the alloying elements previously forming the particles become solutes within the solvent matrix. The solutionizing temperature must in general be above 425° C. and less than 600° C., with a range of 520° C. to 580° C. more preferred. In one embodiment, the solutionizing temperature is about 540° C. and the solutionizing time is about 40 minutes.

After the first heating 30 is complete, the aluminum alloy piece is cooled relatively rapidly, numeral 32, at a cooling rate sufficient to suppress substantial precipitation of second phases in the piece of aluminum alloy and to create a metastable state of supersaturation of at least some of the solute alloying elements in the aluminum matrix. Precipitation intentionally occurs in subsequent steps, but at this stage care is taken so that uncontrolled precipitation of second phases does not occur. This rapid cooling, termed "quenching", is preferably accomplished by contact with water, as by plunging the piece into a volume of water or by spraying or otherwise contacting water with the surface of the piece.

Optionally, the aluminum alloy piece is deformed lightly after solution treating and quenching and prior to further aging. This deformation, generically termed the "stretching" step 34, is achieved either by applying a tensile elongation or stretching to the aluminum alloy piece or by some similar processing that applies a relatively small deformation. The deformation during the stretching step 34, where utilized, is preferably on the order of from about 1 to about 7 percent strain, and no more than about 10 percent strain, collectively termed a "light" deformation. In further embodiments, a stretch of from about 1.5 to about 6% strain may be utilized. The stretching, where utilized, serves to reorient the grains of the aluminum alloy material and to work harden the material. The yield strength and the tensile strength of the material are increased and the elongation to failure is decreased, resulting in reduced fracture toughness, all after subsequent aging. The stretching step 34 therefore may be used to tailor the mechanical and physical properties of the aluminum alloy piece for specific applications.

The aluminum alloy piece is thereafter aged, numeral 36. The term "aged" means that the solution-treated-and-quenched (and optionally stretched) piece is reheated to a temperature less than the temperature used in the first heating 30. The supersaturated solute elements form controlled dispersions of precipitates in the matrix by a diffusionally controlled nucleation-and-growth process. The precipitates formed in the aging treatment are regular and controlled in nature, as distinct from the largely uncontrolled array of particles that is present prior to the solution treating and quenching operation 28. The formation of the precipitates leads to increased strength of the aluminum alloy.

It has been known to age Al-Cu-Li-Sc alloys in a single step aging process at about 130° C. for about 8–12 hours, to achieve maximum yield and tensile strengths. In this state, there is only a small difference between the yield strength and the tensile strength, and as a result there is relatively low elongation to failure and relatively low fracture toughness. These physical properties are acceptable for some applications but not for many others, in contrast to alloys treated in accordance with the subject process, which results in alloys exhibiting superior elongation and fracture toughness.

In the present approach to aging 36, a two-step, sometimes termed "duplex", treatment is used. These two aging steps are termed the "first aging step" 38 and the "second aging step" 40 to distinguish the first solution heating step 30. Between the first aging step and the second aging step, the alloy piece may be cooled to room (ambient) temperature and then reheated to the temperature of the second aging step, or it may be heated directly to the temperature of the second aging step. After the second aging step 40 is complete, the alloy piece is cooled to room temperature, typically by air cooling.

The first aging treatment may be conducted at 120° C. to 140° C. for a time period of from 8 to 30 hours. The second aging step takes place at a higher temperature than the first aging, for example at 150° C. to 170° C. for from 10 to 20 hours.

In one embodiment of the duplex aging treatment, the alloy is heated to a temperature of about 130° C. for a time of about 20 hours, and thereafter heated to a temperature of about 160° C. for a time of about 16 hours.

Figure 2:
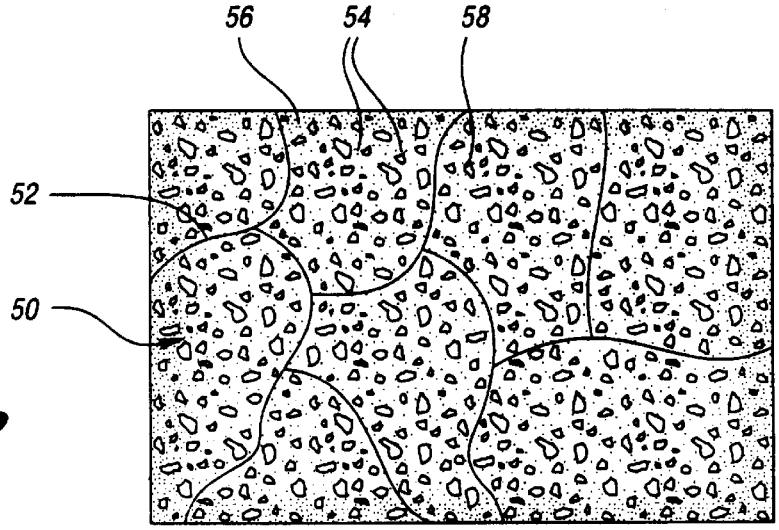
FIG. 2 is a drawing of an idealized microstructure of the aluminum alloy material at the completion of processing according to the invention.

The two-step aging treatment 40 produces a duplex array of precipitates within the matrix alloy, as illustrated in FIG. 2. The alloy piece has a microstructure of fine grains 50 of an aluminum-based alloy matrix with grain boundaries 52. The heating step 38 produces an array of relatively fine $Al_2CuLi$ precipitates 54, termed T1 phase, in the matrix. There is a relatively large precipitate-free zone 56 of T1 phase at the grain boundaries 52. The heating step 40 provides an array of relatively coarse $Al_2Cu$ precipitates, termed θ' phase, and $Al_3Li$ precipitates, termed δ' phase, collectively numeral 58, throughout the grains 50 with relatively small or nonexistent precipitate-free zones at the grain boundaries. The nature of the arrays of precipitates 54 and 58 may be altered by the stretching step 34.

COMPARATIVE EXAMPLE C1

An Al-Cu-Li-Sc alloy termed alloy 1460 was solution treated and quenched followed by single step aging at 130°

C. for 8–12 hours. Physical properties of specimens having nominal width and thickness of 0.50 inch and 0.25 inch, respectively, were measured by conventional ASTM techniques on an Instron® Series 1X Automated Materials Testing System 1.16, with a sample rate of 10.00 pts/sec. and a crosshead speed of 0.100 inch/min. (0.254 cm/min). Ambient temperature was 23° C. (74° F.). The single step aged samples exhibited an ultimate tensile strength of 490 MPa and a tensile yield strength at 0.2% elongation of 431 MPa. The elongation at break was 4%. The difference between yield strength and ultimate tensile strength was 59 MPa.

EXAMPLE 2

Specimens of 1460 alloy were solution treated as described in the most preferred embodiment herein and specimen physical properties measured. An average of four samples resulted in an ultimate tensile strength of 564 MPa with a tensile yield strength at 0.2% elongation of 459 MPa. The elongation at break was 8.75%. The difference between yield strength and ultimate tensile strength was 105 MPa.

While an embodiment of the invention has been illustrated and described, it is not intended that such disclosure illustrate and describe all possible forms of the invention. It is intended that the following claims cover all modifications and alternative designs, and all equivalents, that fall within the spirit and scope of this invention.

What is claimed is:

1. A method for preparing an aluminum-copper-lithium-scandium alloy article, comprising:

a) providing an aluminum alloy comprising, in weight percent, about 2.6% to about 3.3% Cu; about 2.0% to about 2.4% Li; about 0.05 to about 0.14% Sc, balance aluminum and incidental impurities;

b) solution treating said alloy at a temperature and for a time sufficient to form a solid solution followed by rapidly cooling said article such that precipitation of second phases in said alloy is prevented to form a quenched alloy;

c) subjecting said quenched alloy to a first aging step at a temperature of from about 120° C. to about 140° C. for a time of from about 8 to about 30 hours to form an aged alloy;

d) subjecting said aged alloy to a second aging step at a temperature of from about 150° C. to about 170° C. for a time of from 10 to about 20 hours to form a dual aged alloy, wherein the alloy, following step (d), exhibits a difference between tensile yield strength at 0.2% elongation and ultimate tensile strength which is greater than that of an identical alloy subjected to single step aging at 130° C. for 8–12 hours.

2. The method of claim 1 wherein said first aging step occurs at a temperature of about 130° C.

3. The method of claim 1 wherein said second aging step occurs at a temperature of about 160° C.

4. The method of claim 1 wherein said first aging step occurs at a temperature of about 130° C. and said second aging step occurs at a temperature of about 160° C.

5. The method of claim 1 wherein said solution treating occurs at a temperature from about 425° C. to about 600° C.

6. The method of claim 1 wherein said solution treating occurs at a temperature from about 520° C. to about 580° C.

7. The method of claim 1 wherein said solution treating occurs at a temperature of about 540° C.

8. The method of claim 1 wherein said solution treating occurs at about 540° C. for a time of about 40 minutes.

9. The method of claim 1 wherein following said solution treating, said quenched alloy is subjected to a light stretching of less than about 10%.

10. A method of preparing an aluminum-copper-lithium-scandium alloy article, comprising:

a) providing an aluminum alloy comprising, in weight percent, about 2.6% to about 3.3% Cu; about 2.0% to about 2.4% Li; about 0.05 to about 0.14% Sc, balance aluminum and incidental impurities;

b) solution treating said alloy at a temperature and for a time sufficient to form a solid solution followed by rapidly cooling said article such that precipitation of second phases in said alloy is prevented to form a quenched alloy;

c) subjecting said quenched alloy to a first aging step at a temperature such that a T1 phase comprising an array of fine $Al_2CuLi$ precipitates forms primarily in the centers of grains, with a T1 precipitate-free zone at the grain boundaries between aluminum grains to form an aged alloy;

d) subjecting said aged alloy to a second aging step at a temperature higher than the temperature of said first aging step such that an array of coarse precipitates comprising θ' phase $Al_2Cu$ and δ' phase $Al_3$ Li are formed throughout the aluminum grains to form a dual aged alloy.

11. The method of claim 10 wherein said solution treating occurs at a temperature of from about 425° C. to about 600° C.

12. The method of claim 10 wherein said first aging step occurs at a temperature of from about 120° C. to about 140° C.

13. The method of claim 10 wherein said second aging step occurs at a temperature of from about 150° C. to about 170° C.

14. The method of claim 10 wherein said solution treating occurs at a temperature of about 520° C. to 580° C.

15. The method of claim 14 wherein said first aging takes place at a temperature of from about 130° C. to about 140° C. and said second aging takes place at a temperature of about 150° C. to about 170° C.

16. The process of claim 15 wherein said solution treating takes place at about 540° C. for at time of about 40 minutes; said first aging takes place at about 130° C. for a period of from about 8 hours to about 30 hours; and said second aging takes place at a temperature of about 160° C. for a period of about 10 hours to about 20 hours.

17. An aluminum article prepared by the method of claim 1.

18. An aluminum article prepared by the method of claim 10.

19. A heat treated aluminum-copper-lithium-scandium alloy, said alloy comprises aluminum grains, and having a composition comprising, in weight percent, about 2.6% to about 3.3% Cu; about 2.0% to about 2.4% Li; about 0.05 to about 0.14% Sc, balance aluminum and incidental impurities, said aluminum grains having grain boundaries at their peripheries, an array of fine T1 precipitates comprising $Al_2CuLi$ precipitates found primarily in the center of the grains, said grain boundaries having a relatively T1 precipitate-free zone, and array of coarse θ' phase $Al_2Cu$ and δ' phase $Al_3Li$ precipitates throughout said aluminum grains.

* * * * *